US006177915B1

(12) United States Patent
Beeteson et al.

(10) Patent No.: US 6,177,915 B1
(45) Date of Patent: Jan. 23, 2001

(54) DISPLAY SYSTEM HAVING SECTION BRIGHTNESS CONTROL AND METHOD OF OPERATING SYSTEM

(75) Inventors: John S. Beeteson, Romsey; Christopher C. Pietrzak, Winchester, both of (GB)

(73) Assignee: International Business Machines Corporation, Armonk, NY (US)

( * ) Notice: Under 35 U.S.C. 154(b), the term of this patent shall be extended for 0 days.

(21) Appl. No.: 08/297,665

(22) Filed: Aug. 29, 1994

Related U.S. Application Data

(63) Continuation of application No. 08/139,330, filed on Oct. 20, 1993, now abandoned, which is a continuation of application No. 07/713,182, filed on Jun. 10, 1991, now abandoned.

(30) Foreign Application Priority Data

Jun. 11, 1990 (EP) ..... 90306345

(51) Int. Cl.[7] ..... G09G 3/36
(52) U.S. Cl. ..... 345/87; 345/904
(58) Field of Search ..... 340/702, 793, 340/794, 782, 784; 345/903, 904, 1, 5, 207, 88, 89, 103, 87; 348/687, 678, 602, 603, 616, 790, 791, 792; 349/41, 42, 39, 54

(56) References Cited

U.S. PATENT DOCUMENTS

| | | | | |
|---|---|---|---|---|
| 4,281,324 | | 7/1981 | Nonomura et al. | 340/784 |
| 4,386,345 | * | 5/1983 | Narveson et al. | 340/745 X |
| 4,740,786 | * | 4/1988 | Smith | 340/784 |
| 4,801,933 | * | 1/1989 | Yamamoto et al. | 340/702 X |
| 4,825,201 | * | 4/1989 | Watanabe et al. | 340/793 X |
| 4,897,639 | * | 1/1990 | Kanayama | 340/782 X |

FOREIGN PATENT DOCUMENTS

| | | | |
|---|---|---|---|
| 0216188 | | 4/1987 | (EP) . |
| 0238867 | | 9/1987 | (EP) . |
| 0295689 | | 12/1988 | (EP) . |
| 0403268 | * | 12/1990 | (EP) ..... 345/103 |
| 0462333 | | 12/1991 | (EP) . |

* cited by examiner

*Primary Examiner*—Chanh Nguyen
(74) *Attorney, Agent, or Firm*—Scully, Scott, Murphy & Presser; Marian Underweiser

(57) ABSTRACT

A display system for displaying a visual image in response to a video signal (10,34), comprising; a liquid crystal display panel (1) divided into a plurality of addressable, variable brightness sections (5); address circuit (6) for generating a section address corresponding to a section in response to a timing signal (11); driver circuit (7,8) for varying the brightness of the section in response to a brightness signal (14,15) derived from the video signal (10,34); characterised in that the display system further comprises: a memory (36) for storing a predetermined correction signal (35) corresponding to the section; and control circuit (31) coupled to the driver circuit (7,8) for varying the brightness signal (14,15) to reduce brightness non-uniformities in the displayed image in response to the video signal (34) and the correction signal (35) in combination. The control circuit preferably includes a summing circuit for adding the correction signal to the video signal to produce a summed signal for determining the brightness signal. In another preferred embodiment the control circuit includes a voltage control circuit for varying the amplitude of the brightness signal in response to the correction signal.

22 Claims, 6 Drawing Sheets

DISPLAY SYSTEM HAVING SECTION BRIGHTNESS CONTROL AND METHOD OF OPERATING SYSTEM

This application is a continuation of application Ser. No. 08/139,330 filed on Oct. 20, 1993 , now abandoned which is a continuation of application Ser. No. 07/713,182 now abandoned, filed on Jun. 10, 1991.

TECHNICAL FIELD

The present invention relates to a display system and more particularly to a display system including a Liquid Crystal Display (LCD) panel comprising an array of individually addressable pixel cells.

BACKGROUND ART

LCD screens for such display systems include passive LCD screens and Thin Film Transistor (TFT) LCD screens.

A passive LCD panel includes two orthogonal arrays of parallel conductive tracks in the form of rows and columns. A layer of liquid crystal material is placed between the two arrays thereby forming a capacitor at each intersection of the orthogonal arrays. The capacitor of an intersection is charged by placing a voltage across the corresponding conductive tracks. When the capacitor is charged, a light path is produced through the liquid crystal material at the intersection thereby generating a pixel cell.

In a TFT LCD, the liquid crystal material is placed between a planar electrode and an array of separate pixel electrodes. Each pixel electrode is coupled to the drain of a transistor switch. The transistor switch is located at the intersection of two orthogonal conductive tracks (row and column tracks). The source of the transistor is coupled to the column track and the gate is coupled to the row track. The transistor switch turns on when a voltage is applied on the row track. In response to the transistor turning on, the capacitor formed between the pixel electrode and the planar electrode charges up to a data voltage applied to the column track. When the transistor is subsequently turned off, the charge stored in the capacitor remains. A light path is produced through the liquid crystal material at the pixel electrode thereby generating the pixel cell.

Passive and TFT LCD screens can exhibit a brightness non-uniformity when the displayed image is generated by a grey scale video signal. The non-uniformity error takes the objectionable visual appearance of spurious brightness variations distributed across the LCD panel. These variations limit the quantity of grey scale brightness levels that can unambiguously be generated.

The brightness non-uniformity can arise from variations in thickness of the liquid crystal layer. This effect is particularly significant where the liquid crystal layer is made thin (typically 4 um) to reduce the transient response period of the LCD panel. In reduced layer thickness LCD screens, any slight variation in the layer thickness causes a corresponding variation in brightness. In colour LCDs, further thickness variations can be introduced by colour filter layers. These further variations add to the effect.

The brightness non-uniformity can also arise from variations in molecular orientation of any liquid crystal alignment layers applied to inner surfaces of the LCD panel.

Furthermore, the brightness non-uniformity can arise from variations in electrical characteristics of the row tracks, the column tracks or the thin film transistors (of a TFT LCD), or any combination thereof.

SUMMARY OF THE INVENTION

An aim of the present invention is therefore to provide a display system having an LCD display panel which does not exhibit spurious brightness variations.

According to the present invention there is now provided a display system for displaying a visual image in response to a video signal, comprising: a liquid crystal display panel divided into a plurality of addressable, variable brightness sections; address means for generating a section address corresponding to a section in response to a timing signal; driver means for varying the brightness of the section in response to a brightness signal derived from the video signal; characterised in that the display system further comprises: a memory for storing a predetermined correction signal corresponding to the section; and control means coupled to the driver means for varying the brightness signal to reduce brightness non-uniformities in the displayed image in response to the video signal and the correction signal in combination.

This has an advantage in that any spurious brightness variations in the image displayed on the LCD panel can now be removed by generating appropriate correction data during the manufacture of the display system and storing this correction data in the memory for retrieval during the operation of the display system.

In a particularly preferred embodiment of the present invention to be described later, each section comprises a plurality of addressable, variable brightness pixel cells. However, it will be appreciated that in other embodiments of the present invention, each section may comprise a single variable brightness pixel cell.

In one preferred embodiment to be described later, the control means comprises a summing circuit for adding the correction signal to the video signal to produce a summed signal for determining the brightness signal.

In another preferred embodiment to be described later the control means includes a voltage control circuit for varying the amplitude of the brightness signal in response to the correction signal.

In the preferred embodiments of the present invention to be described later, the memory comprises a Programmable Read Only Memory wherein each correction signal is stored in the memory in the form of a two bit binary number. In this example of the present invention, the memory is operable for storing a plurality of correction signals in the form of a look up table wherein each correction signal corresponds to a different section of the LCD panel.

In a preferred example of a display system of the present invention, there is provided a section decoder for generating a memory address for addressing the correction signal stored in the the memory in response to the section address. However, it will be appreciated that in other examples of the present invention, the memory address may be generated by a computer system operating under the instruction of a computer program.

These and other embodiments of the present invention have the advantage that the electrical circuitry associated with the display system of the present invention can be included in an inexpensive and simple integrated circuit package. A display system of the present invention can therefore be produced without significantly affecting manufacturing costs.

BRIEF DESCRIPTION OF THE DRAWINGS

Preferred examples of the present invention will now be described with reference to the accompanying drawings in which.

DETAILED DESCRIPTION OF THE PREFERRED EMBODIMENTS

Figure 1:
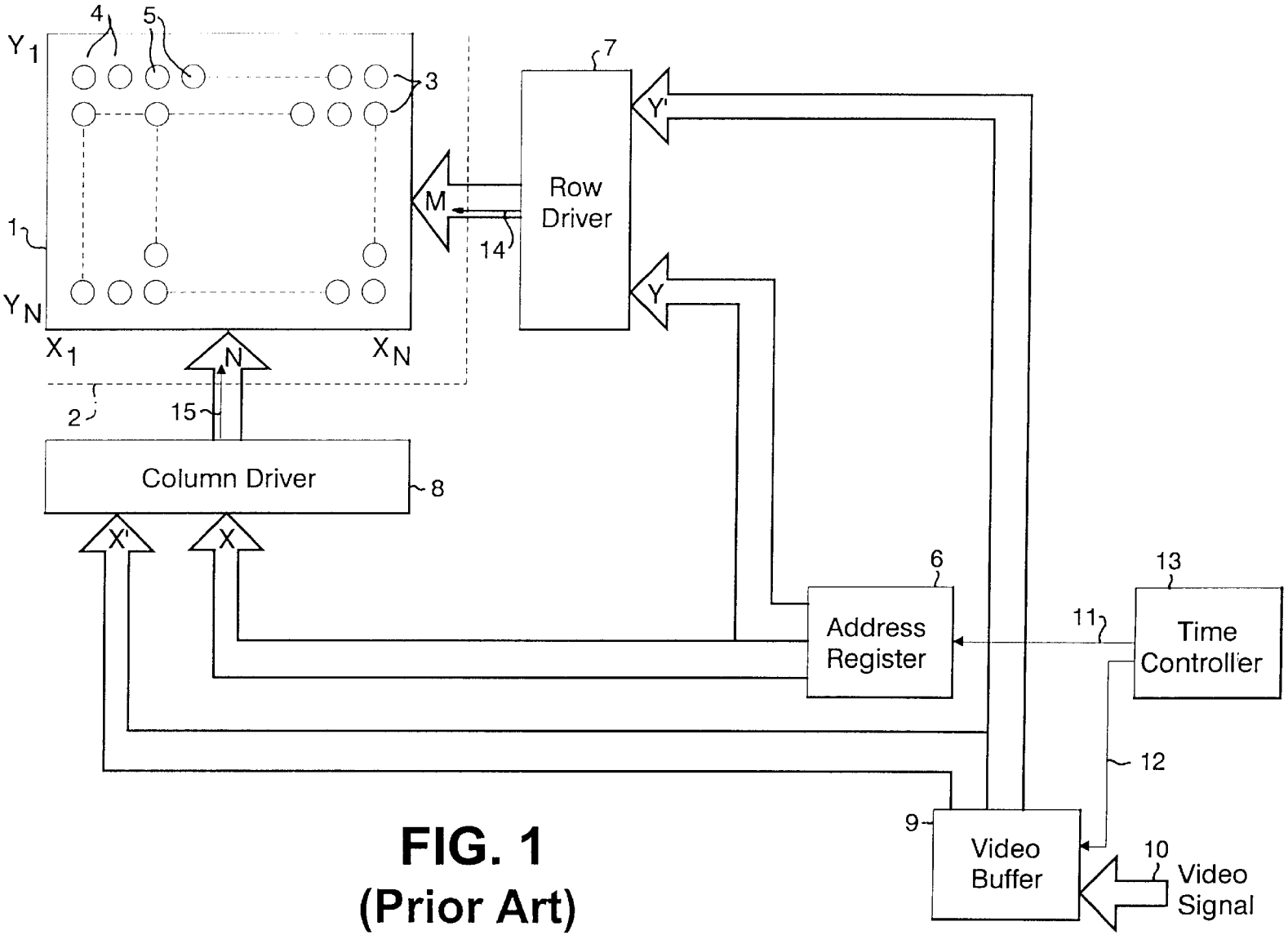
FIG. 1 (Prior Art)
FIG. 1 is a block diagram of an LCD display comprising an LCD panel and a LCD panel controller circuit of the prior art.

Before describing the invention, by way of explanation, an LCD display of the prior art will now be described with reference to FIG. 1. The LCD display includes a passive LCD panel 1 and a controller circuit 2 for generating an image on the LCD panel. The LCD panel consists of individually addressable pixel cells 5 arranged into rows 3 and columns 4. Each pixel cell is addressed by a row address Ym and a column address Xn. The brightness of a particular pixel cell is determined by a row brightness value Y' and a column brightness value X'. The row brightness value Y' is translated into a row drive signal 14 by a row driver 7. The column brightness value X' is translated into a column drive signal 15 by a column driver 8. A video buffer 9 generates the row and column brightness values in response to an analogue input video signal 10. The row drive signal 14 is applied to a row specified by a row address Y. The column drive signal 15 is applied to a column specified by a column address X. The row and column addresses are stored in an address register 6. The row and column addresses in the address register 6 are changed in response to a register control signal 11. The register control signal 11 is generated by a timing controller 13. The timing controller 13 also generates a gating signal 12. The gating signal 12 ensures that an appropriate brightness is assigned to a particular pixel cell by synchronising the input video signal 10 to the register control signal 11.

In operation the image displayed on the LCD panel is refreshed by sequentially addressing the rows of pixel cells. The row drive signal 14 is addressed to a particular pixel row and a separate column drive signal 15 is applied to each pixel column simultaneously. An entire row of pixel cells is thus refreshed simultaneously. The row address Y is then incremented and the row drive signal is applied to the an adjacent pixel row.

Figure 2:
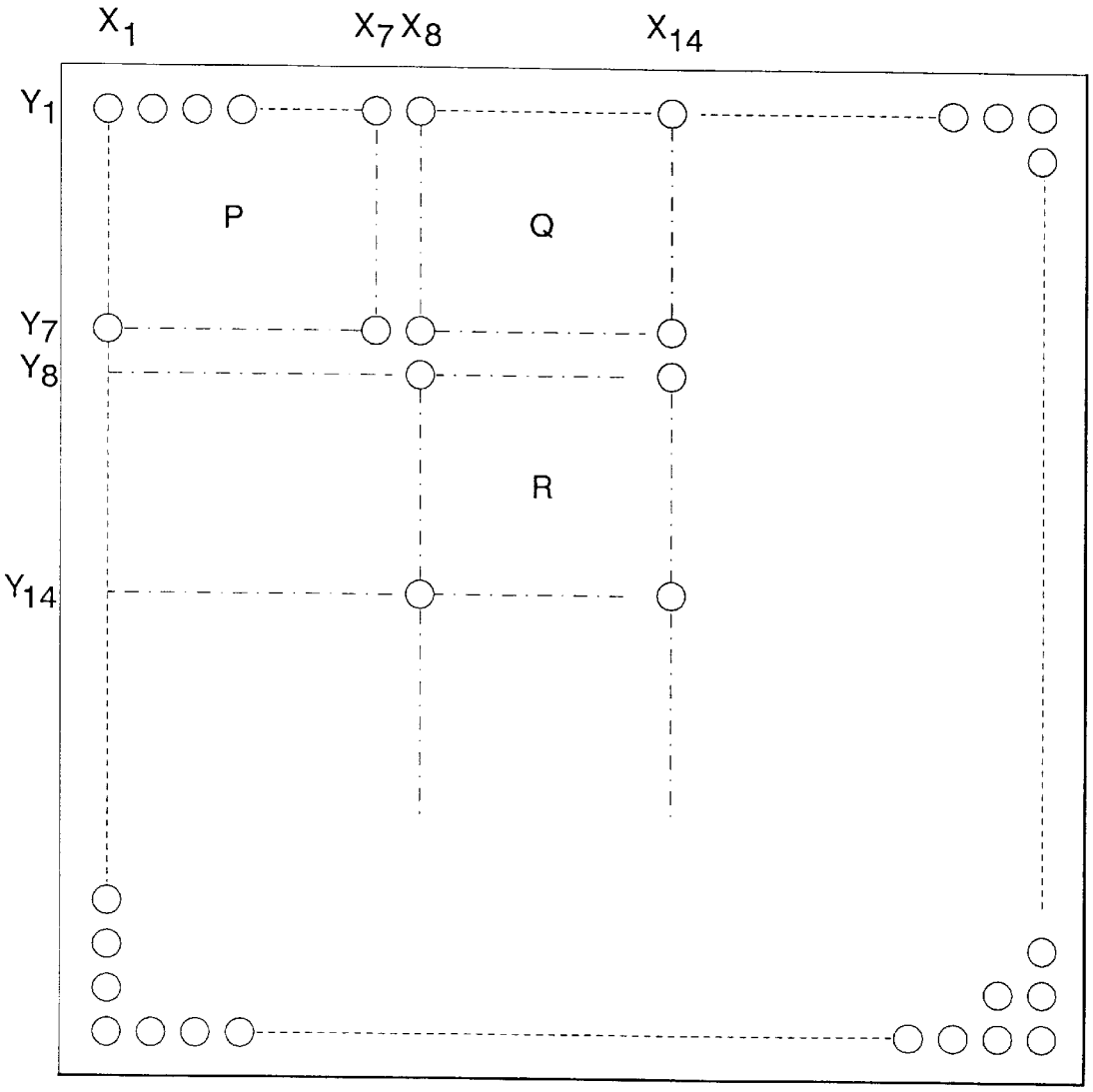
FIG. 2 is a plan view of an LCD panel of the present invention.
Figure 3:
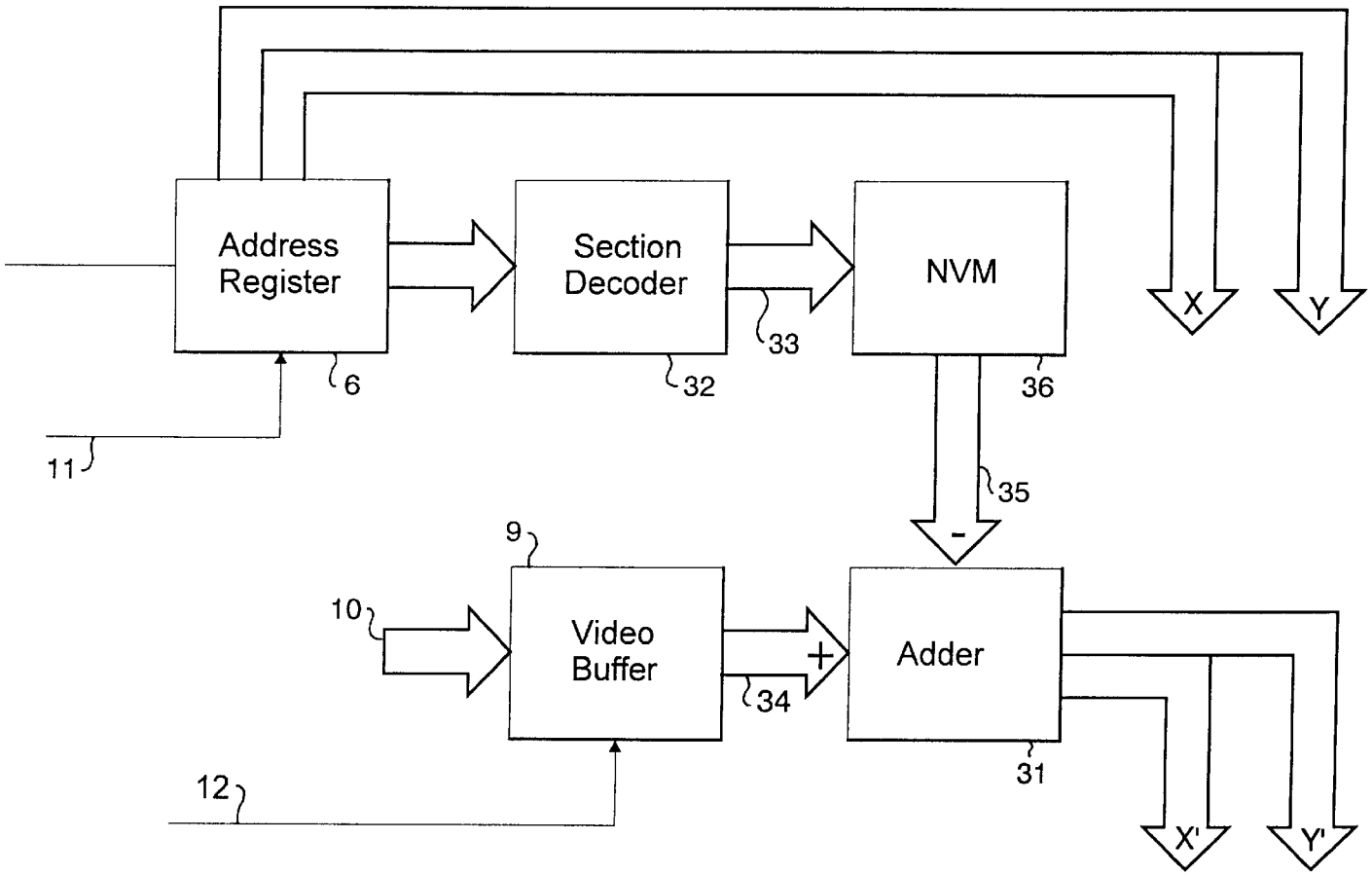
FIG. 3 is a block diagram of a controller circuit of the present invention.

An LCD panel of the present invention will now be described with reference to FIG. 2. In one embodiment of the present invention, the LCD panel is typically 225 mm wide and 170 mm high. The panel area is divided into 4520 3 mm square sections (P,Q,R). Each section is defined by different groups of rows and columns of pixel cells. For example, section P contains pixel cells in rows Y1 to Y7 and columns X1 to X7. A controller circuit for controlling the LCD panel of the present invention will now be described with reference to FIG. 3. The video signal 10 is connected to the video buffer 9. The video buffer 9 latches row and column image brightness values 34 corresponding to a particular pixel cell to an adder 31 in response to the gating signal 12. The adder 31 determines the row and column brightness values Y' and X' for the pixel cell in response to the image brightness values 34 and a brightness correction value 35. The brightness correction value is a two bit binary number corresponding to the section of the LCD panel containing the pixel cell. Each section is associated with a different correction value stored in an 8.5 Kilobit Programmable Read Only Memory (PROM) 36. A section decoder 32 decodes the row and column addresses specifying the pixel cell to produce a PROM address 33. The PROM address selects the brightness correction value 35 corresponding to the section of containing the pixel cell.

Figure 4:
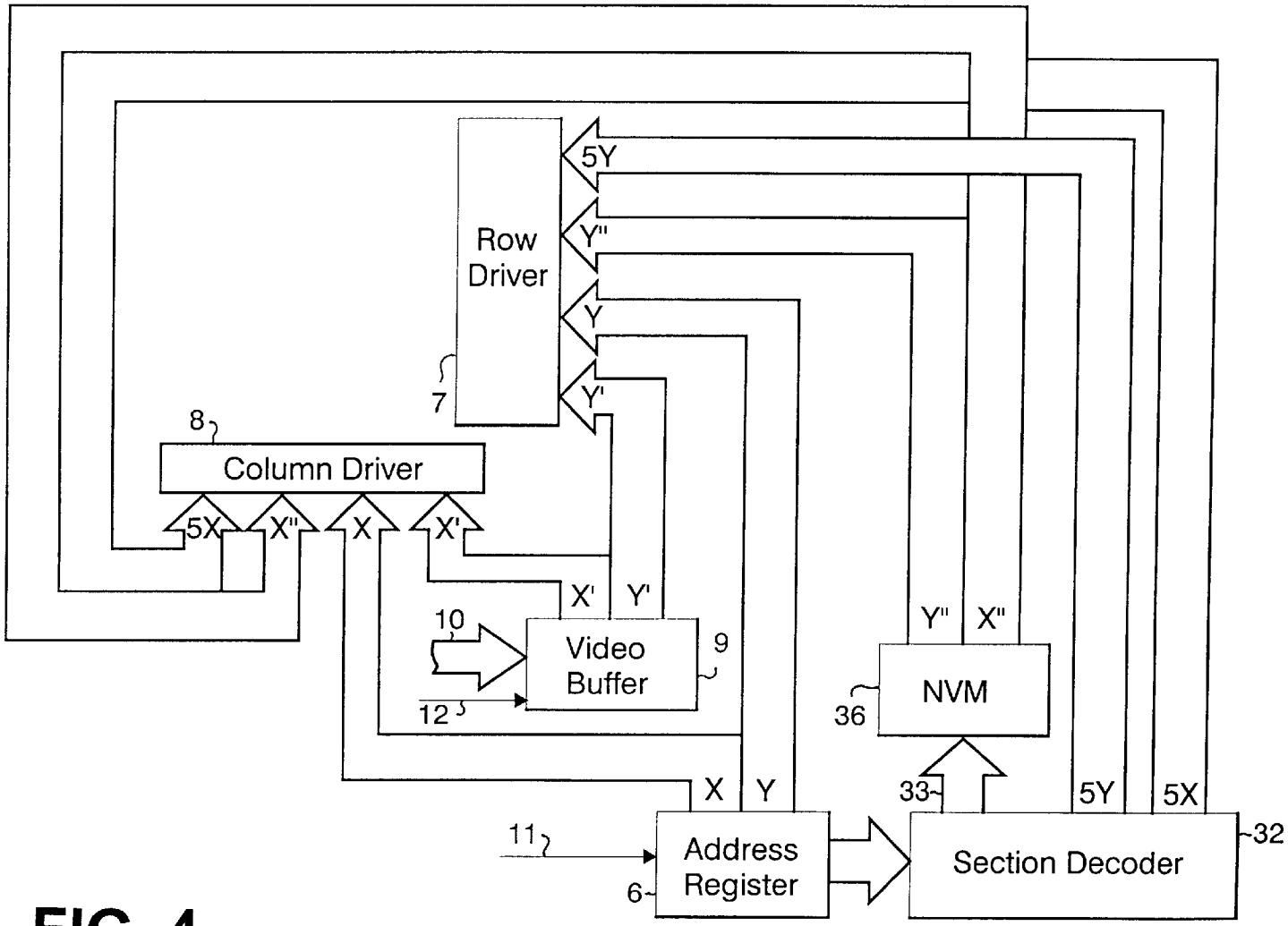
FIG. 4 is a block diagram of another controller circuit of the present invention

Another controller circuit for controlling the LCD panel in accordance with the present invention will now be described with reference to FIG. 4. The video signal 10 is connected to the video buffer 9. The video buffer 9 latches row brightness value Y' to the row driver 7 and column a column brightness value X' to the column driver 8. The brightness values correspond to a particular pixel cell. The row driver 7 translates the row brightness value Y' into a row drive signal 14. The column driver 8 translates the column brightness value X' into a column drive signal 15. The row and column drive signals determine the brightness of the pixel cell. The amplitude of the row drive signal 14 is also controlled by a row correction value Y". Similarly, the amplitude of the column drive signal 15 is controlled by a column correction value X". The correction values X" and Y" correspond to the section of the LCD panel containing the pixel cell. Each section is associated with a different pair of correction values X",Y" stored in a Programmable Read only Memory (PROM) 36. A section decoder 32 decodes the row and column addresses specifying the pixel cell to produce a PROM address 33, a row section address Sy, and a column section address Sx. The PROM address 33 selects the pair of correction values X",Y" corresponding to the section of the LCD panel containing the pixel cell. Row drive signals are applied to the rows in this section by a section driver in the row driver. Similarly, drive signals are applied to the columns in this section by a section driver in the column driver. The row section address addresses the row correction value to the row section driver. Similarly the column section address addresses the column correction value to the column section driver.

Figure 5:
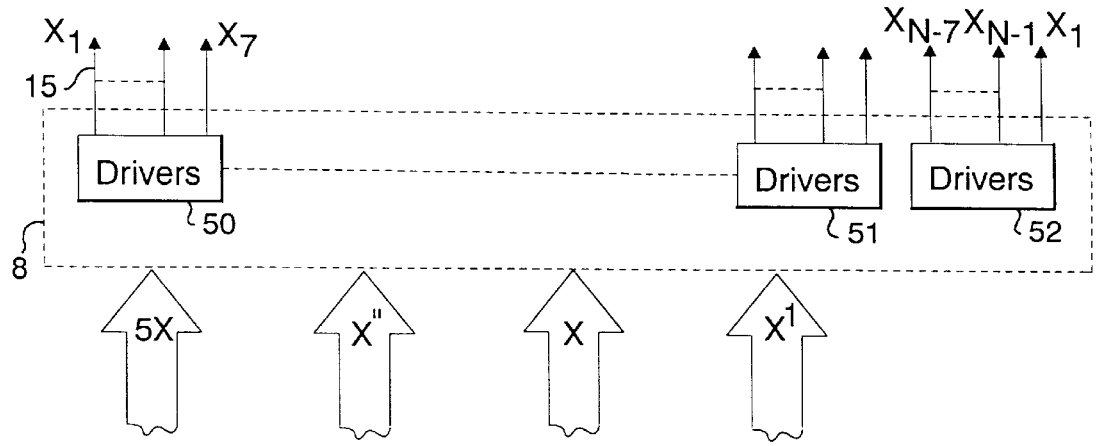
FIG. 5 is a block diagram of a column buffer of the present invention.

FIG. 5 is a block diagram of the column driver 8 divided into an array of column section drivers 50,51,52. A particular section driver 50 generates separate drive signals in the form of voltage levels applied to seven adjacent columns, X1 to X7, of the LCD panel. The voltage levels are initially determined by seven separate image brightness values. The voltage levels applied to the columns are adjusted at the outputs of the column section driver in response to the correction value addressed to the column section driver.

Figure 6:
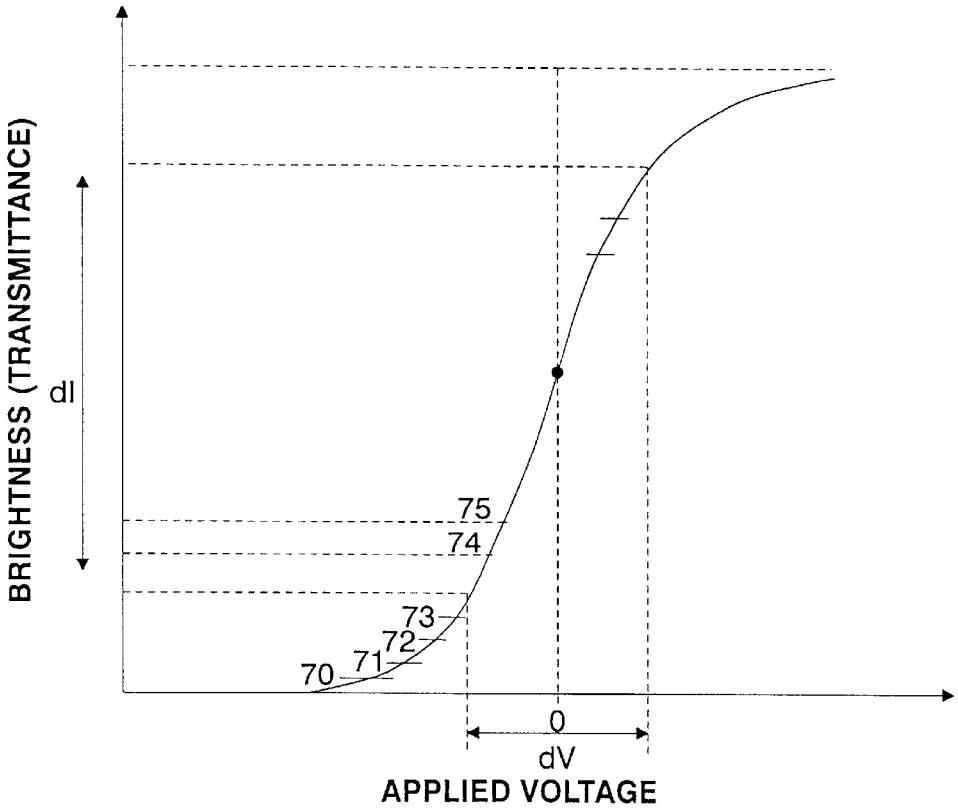
FIG. 6 is a graph indicating the relationship between cell voltage and cell transmittance (brightness) of the LCD panel.

The relationship between the brightness values and the brightness correction values will now be explained further with reference to FIG. 6. FIG. 6 is a graph in the form of a curve to illustrate the relationship between pixel cell light transmittance and the voltage applied to the pixel cell for a typical LCD panel. The pixel cell transmittance determines the brightness of the pixel cell when the LCD panel is back lit by a suitable light source. The curve approximates to a straight line in voltage range dV which corresponds to transmittance range dI. Therefore any change in the voltage applied to the pixel cell produces a proportional change in the pixel brightness providing the voltage remains within the range dV. In the LCD display, the controller circuit effectively quantises the voltage range dI into a digital sequence of brightness values (74,75). In a preferred embodiment of the present invention, the voltages corresponding to the brightness correction values are located towards the low transmittance end of the curve (70,71,72,73) outside the voltage range dV, since the effect of the correction values on the displayed image is preferably small in comparison with the effect of the brightness values.

Figure 7:
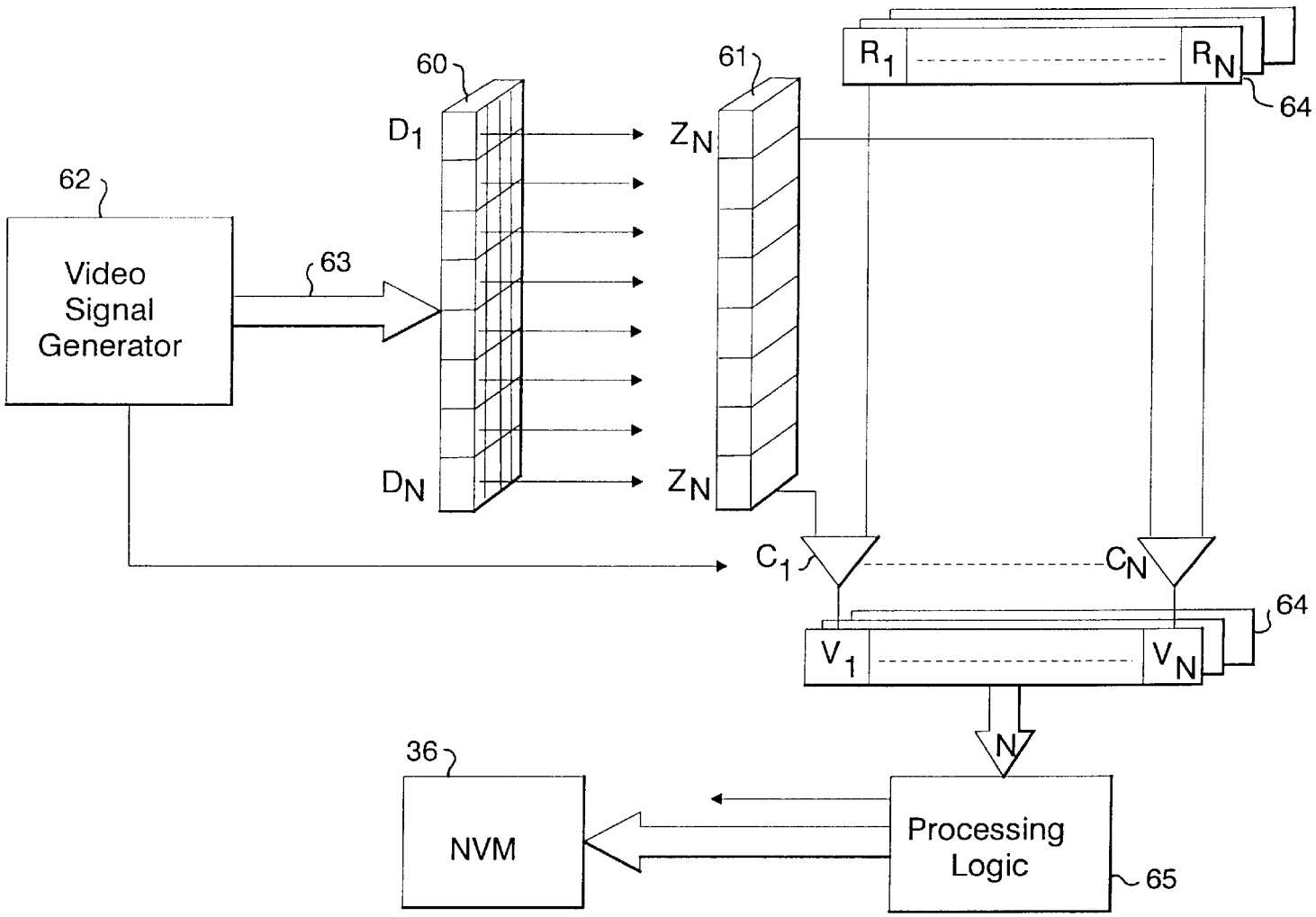
FIG. 7 is a block diagram of a system for analysing the LCD panel and determining brightness correction values for the LCD display.

A system for analysing the output response of the LCD panel and determining correction values for the LCD display will now be described with reference to FIG. 7. The system comprises an optical sensor array 61 for detecting the visual output from the LCD panel 60. Each sensor in the sensor array corresponds to a different section of the LCD panel. For example, sensor Z1 corresponds to section D1. A grey scale video generator 62 generates a test video signal 63 for filling the LCD panel with a low brightness block. The response of each section of the LCD panel to the test video signal is measured by a different sensor in the sensor array. A comparator array C1 and CN digitally compares the measured grey levels with corresponding reference grey levels stored in a system memory 64. The difference values between the corresponding measured and reference grey levels are stored in the system memory 64. This process is repeated using a higher brightness block. A brightness correction value for a a particular section of the LCD panel is determined by averaging the difference values corresponding to the section. The brightness correction value is recorded in the PROM 36 of the LCD display by processing logic 65.

Examples of the present invention have been described with reference to a LCD display comprising a passive LCD panel. However, it will be appreciated be appreciated that the present invention is also applicable to LCD displays comprising Thin Film Transistor LCD panels. Furthermore, it will be appreciated that, whilst the examples of the present invention described in the preceding paragraphs include an 225×117 mm LCD panel, the present invention is equally applicable to LCD panels of other dimensions.

What is claimed is:

1. A display system for displaying a visual image in response to a video signal (10,34), comprising;

a display consisting of a single LCD panel (1) divided into a plurality of addressable, variable brightness sections (5) wherein different parts of said panel are subject to spurious brightness non-uniformities from section to section of said panel;

address means (6) for generating a section address corresponding to a section in response to a timing signal (11);

driver means (7,8) for varying the brightness of the section in response to a brightness signal (14,15) derived from the video signal (10,34);

a memory (36) for storing a predetermined correction signal (35) corresponding to the section; and control means (31) coupled to the driver means (7,8) for varying the brightness signal (14,15) to reduce said brightness non-uniformities in the displayed image in response to the video signal (34) and the correction signal (35) in combination.

2. A display system as claimed in claim 1 wherein each section comprises a plurality of addressable, variable brightness pixel cells.

3. A display system as claimed in claim 2 wherein the control means comprises a summing circuit for adding the correction signal to the video signal to produce a summed signal for determining the brightness signal.

4. A display system as claimed in claim 2 wherein the control means includes a voltage control circuit for varying the amplitude of the brightness signal in response to the correction signal.

5. A display system as claimed in claim 2 wherein the memory is operable for storing a plurality of correction signals in the form of a look up table, and wherein each correction signal corresponds to a different section of the LCD panel.

6. A display system as claimed in claim 1 wherein the control means comprises a summing circuit for adding the correction signal to the video signal to produce a summed signal for determining the brightness signal.

7. A display system as claimed in claim 6 further comprising a section decoder for generating a memory address corresponding to the correction signal stored in the the memory in response to the section address.

8. A display system as claimed in claim 7 wherein each correction signal is stored in the memory in the form of a two bit binary number.

9. A display system as claimed in claim 8 wherein the memory comprises a Programmable Read Only Memory.

10. A display system as claimed in claim 7 wherein the memory comprises a Programmable Read Only Memory.

11. A display system as claimed in claim 7 wherein the memory is operable for storing a plurality of correction signals in the form of a look up table, and wherein each correction signal corresponds to a different section of the LCD panel.

12. A display system as claimed in claim 6 wherein the memory is operable for storing a plurality of correction signals in the form of a look up table, and wherein each correction signal corresponds to a different section of the LCD panel.

13. A display system as claimed in claim 1 wherein the control means includes a voltage control circuit for varying the amplitude of the brightness signal in response to the correction signal.

14. A display system as claimed in claim 13 further comprising a section decoder for generating a memory address corresponding to the correction signal stored in the memory in response to the section address.

15. A display system as claimed in claim 14 wherein each correction signal is stored in the memory in the form of a two bit binary number.

16. A display system as claimed in claim 13 wherein the memory is operable for storing a plurality of correction signals in the form of a look up table, and wherein each correction signal corresponds to a different section of the LCD panel.

17. A display system as claimed in claim 1 wherein the memory is operable for storing a plurality of correction signals in the form of a look up table, and wherein each correction signal corresponds to a different section of the LCD panel.

18. A display system as claimed in claim 1 comprising a thin film transistor liquid crystal display panel.

19. A display system as claimed in claim 1 comprising a passive liquid crystal display panel.

20. The display system as claimed in claim 1 wherein the brightness non-uniformities are caused by variations in characteristics across the liquid crystal display panel.

21. The display system as claimed in claim 20 wherein the characteristics include at least one of variations in thickness of a liquid crystal layer of said panel, variations in thickness introduced by color filter layers of said panel, variations in molecular orientation of liquid crystal alignment layers applied to inner surfaces of the panel, and variations in electrical characteristics of row tracks, column tracks and thin film transistors of said panel.

22. A method for reducing brightness non-uniformities in a visual image generated in response to a video signal by a display system comprising:

a display consisting of a single LCD panel divided into a plurality of addressable, variable brightness sections wherein different parts of said panel are subject to spurious brightness non-uniformities from section to section of said panel;

address means for generating a section address for addressing a brightness signal derived from the video signal to a section; and driver means for varying the brightness of the section in response to the brightness signal;

the method comprising: storing a predetermined correction signal corresponding to the section in a memory of the display system; and varying the brightness signal in response to both the video signal and the correction signal to correct for said spurious brightness non-uniformities.

* * * * *